US005359744A

United States Patent [19]

Kimball et al.

[11] Patent Number: 5,359,744

[45] Date of Patent: Nov. 1, 1994

[54] FABRIC SOFTENER DISPENSER SYSTEM FOR AN AUTOMATIC WASHER

[75] Inventors: Vance A. Kimball, Lincoln Township, Berrien County; Vincent P. Gurubatham; Phalguni S. Roy, both of St. Joseph, all of Mich.

[73] Assignee: Whirlpool Corporation, Benton Harbor, Mich.

[21] Appl. No.: 106,673

[22] Filed: Aug. 16, 1993

[51] Int. Cl.[5] ..... D06F 39/02

[52] U.S. Cl. ..... 8/158; 68/17 R; 68/207

[58] Field of Search ..... 68/17 A, 17 R, 207; 8/158, 159

[56] References Cited

U.S. PATENT DOCUMENTS

| | | | |
|---|---|---|---|
| 3,620,054 | 11/1971 | Drews et al. | 68/17 A |
| 3,897,806 | 8/1975 | Waugh et al. | 68/17 R |
| 4,066,393 | 1/1978 | Morey et al. | 68/17 R |
| 4,186,573 | 2/1980 | Brenner et al. | 68/12 R |
| 4,328,600 | 5/1982 | Bochan | 8/159 |
| 4,329,859 | 5/1982 | Roberts | 68/23 R |
| 4,410,329 | 10/1983 | Blevins et al. | 8/158 |
| 4,411,664 | 10/1983 | Rickard et al. | 8/158 |
| 4,440,004 | 4/1984 | Bochan | 68/23 R |
| 5,092,141 | 3/1992 | Quinn | 68/17 R |

FOREIGN PATENT DOCUMENTS

| | | | |
|---|---|---|---|
| 59-166190 | 9/1984 | Japan | 68/17 A |

*Primary Examiner*—Frankie L. Stinson

*Attorney, Agent, or Firm*—Joel M. Van Winkle; Stephen D. Krefman; Robert O. Rice

[57] ABSTRACT

A wash additive dispensing system and method for an automatic washer having a wash additive dispenser disposed on the upper portion of an agitator rotatably mounted within a wash basket. The wash additive dispenser comprises a receiving cup capable of receiving a wash additive and a dispensing cup secured to receive wash additive from the receiving cup. A cover member is disposed above the receiving cup and includes a funnel portion extending down into the receiving cup. During a fill cycle operation, a portion of wash liquid flowing into the wash basket through a water inlet device is channeled into a wash liquid supply conduit secured to the underside of a washer lid disposed above the wash basket. The supply conduit has a drain port positioned above the funnel portion of the cover member such that wash liquid continuously drains into the receiving cup through the funnel portion during the fill cycle. The dispenser also includes an overflow tube for channeling excess wash liquid added to the receiving cup into the dispensing cup. Prior to an agitation cycle, therefore, the receiving cup receives wash additive and wash liquid. During the agitation cycle the wash liquid and the wash additive disposed within the receiving cup thoroughly mix to form a diluted wash additive. The dispenser then drains the diluted wash additive into the wash tub subsequent to a high speed spin extraction cycle.

17 Claims, 5 Drawing Sheets

FIG. 8
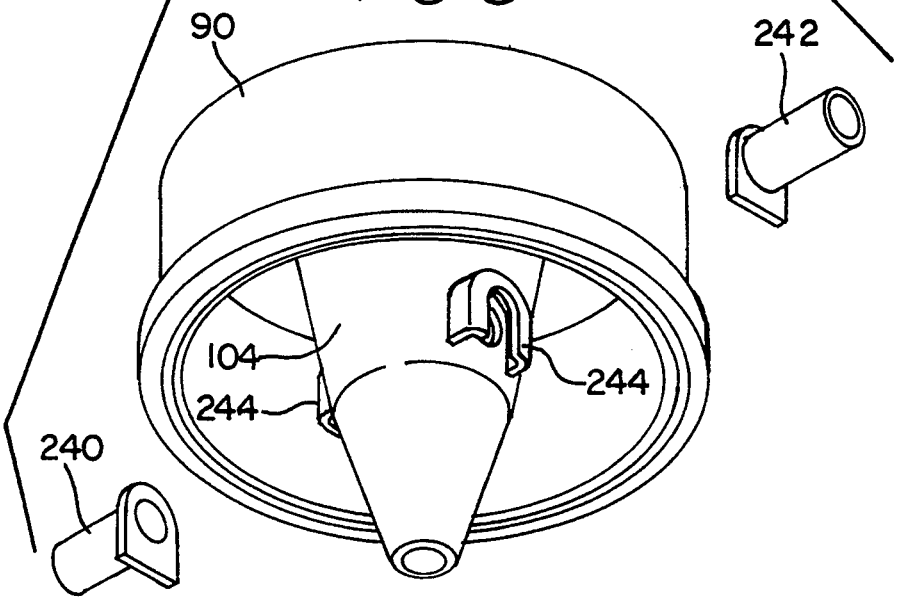
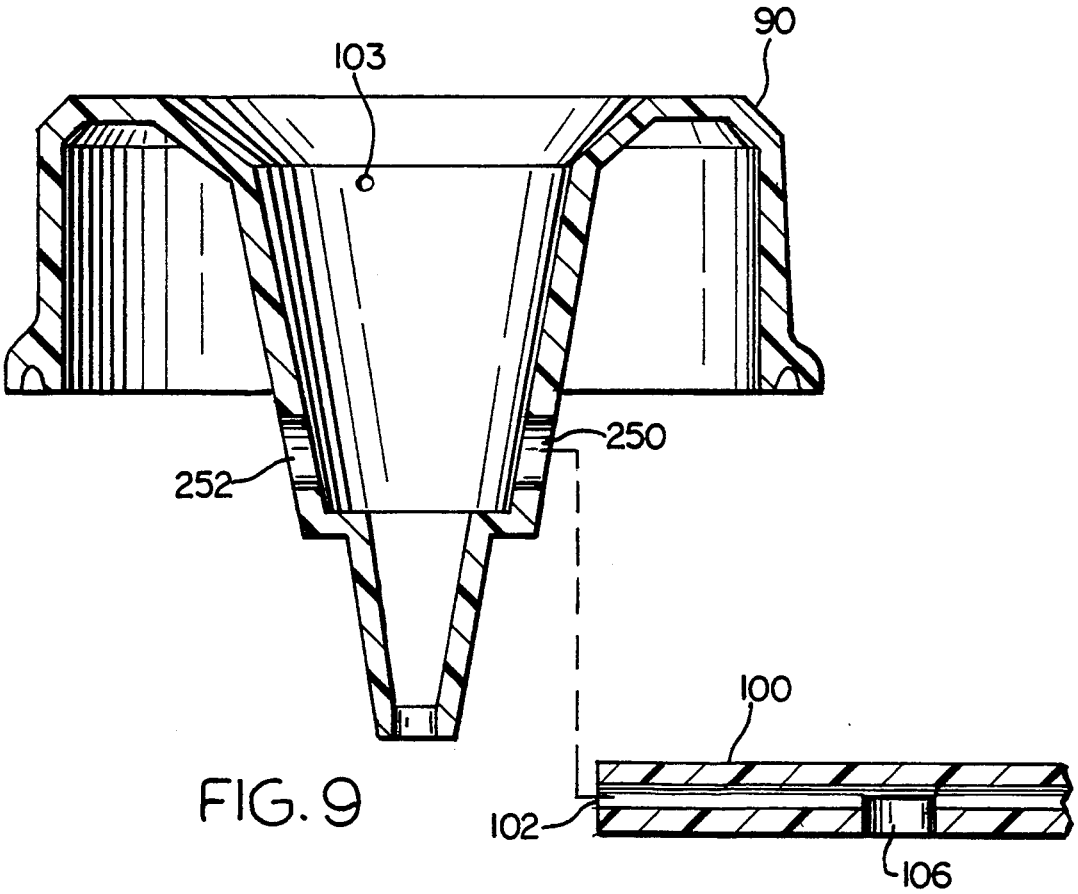
FIG. 9

FABRIC SOFTENER DISPENSER SYSTEM FOR AN AUTOMATIC WASHER

BACKGROUND OF THE INVENTION

This invention relates generally to automatic washers and means for dispensing wash additives inside automatic washers at a designated point during their programmed cycles of operation. More particularly still, the invention relates to a centrifugally activated dispenser system having a means for ensuring complete dispensing of all wash additives added to the dispenser as well as automatic rinsing of the dispenser after dispensing.

A number of different types of dispensers for liquids in automated washing devices have been used heretofore. Among these are such differing approaches as electromechanical devices which require programmed remote actuation, as well as a number of what are essentially self-actuated devices of a primarily mechanical nature which respond to various conditions during the operation of the washing machine, often a predetermined agitator speed threshold, to dispense liquids at some given point during the washing process without the need for external control devices.

Centrifugally actuated dispensers are frequently encountered in the latter group, and a good example of such a device is that shown in U.S. Pat. No. 4,656,844, which is commonly owned herewith and which is hereby incorporated by reference. As discussed in that patent, centrifugal dispensers typically employ a cup-like first receptacle which is usually either mounted upon the agitator or secured to the basket of the washing machine. The liquid additive contained within the first receptacle is forced upwardly and outwardly along the receptacle walls as the rotational speed of the agitator or basket increases, typically during a spin cycle, until the point is reached where the additive escapes over the edge of the receptacle and is received into a second receptacle. When the basket slows down, the fluid works its way under the influence of gravity, to the wash basket to contact the wash load.

It is known that these types of fabric softeners have some drawbacks. Specifically, most liquid wash additives used in combination with the prior art dispenser configuration are formulated such that use over a period of time results in deposits of dried unused liquid accumulating at various places in the dispensers. To overcome this deficiency of the liquid dispensing devices, typically, wash additives dispensers have been configured to be removable from the laundry appliance so that they may be rinsed manually at periodic intervals to prevent the above described build-up. In an effort to address this type of problem, U.S. Pat. No. 4,186,573 discloses a laundry liquid dispenser which is positioned onto the rim of a rotary spin basket. Subsequent to the dispensing of the wash additive into the spin basket, the dispenser may pass beneath a water inlet source and, in this fashion, receive clean inlet water so as to rinse out the dispenser.

In addition to the above-described drawback, the inventors have found that some liquid additives, such as certain fabric softeners, being relatively viscous in comparison to other fabric softeners, do not dispense satisfactorily from the known centrifugal wash additive dispensers. These more viscous fabric softeners do not readily flow out of the above mentioned first receptacle into the second receptacle. Further, these highly viscous fabric softeners do not readily flow from the second receptacle into the wash basket under the influence of gravity. As a result, a substantial portion of fabric softener remains in the dispenser at the conclusion of the wash cycle. This remaining fabric softener may, during the period between wash cycles, slowly travel to the bottom of the wash tub such that upon subsequent use of the washing machine, this fabric softener may chemically combine with detergent placed in the wash basket to form an undesirable substance which may result in unsatisfactory wash performance.

None of the centrifugal liquid dispensing devices known in the art are constructed to overcome this problem of unsatisfactory dispensing of highly viscous wash additives. It would be a substantial improvement in the art, therefore, if a dispenser system were provided which overcame the problem of undesirable wash additive deposit accumulation over time and provided for satisfactory dispensing of wash additives regardless of viscosity.

SUMMARY OF THE INVENTION

The present invention overcomes the disadvantages of the prior art, at least in part, by providing a dispenser system having means of supplying wash liquid to the dispenser prior to dispensing for mixing with the wash additive. This concept is completely absent from the prior art. In fact, the prior art teaching related to supplying wash liquid to an agitator mounted dispensing system teaches the use of the wash liquid as a means to cause dispensing of the wash additive. The present invention, in contrast, uses wash liquid applied to the dispensing system prior to dispensing for diluting the wash additive to ensure satisfactory dispensing. Further, subsequent additions of wash liquid may be used to thoroughly clean the dispenser system.

Accordingly, one object of the invention is to satisfactorily dispense highly viscous liquid wash additive from an agitator mounted wash additive dispenser system.

Another object is to supply washing liquid to the dispenser for diluting the wash additive contained in the dispenser.

Still another object is to enhance mixing of the wash additive and wash liquid within the dispenser prior to dispensing.

Yet another object is to continuously supply wash liquid to the dispenser during operation of the fill valves of the automatic washer and to configure the dispenser such that predispensing of the wash additive does not occur in spite of the addition of excess wash liquid.

According to the present invention, the foregoing and other objects are attained by a wash additive dispensing system for an automatic washer having a wash additive dispenser disposed on the upper portion of an agitator rotatably mounted within a wash basket. The wash additive dispenser comprises a receiving cup capable of receiving and containing a wash additive and a dispensing cup secured to receive wash additive from the receiving cup. A cover member is disposed above the receiving cup and includes a funnel portion extending downwardly into the receiving cup.

During a fill cycle operation, wash liquid enters the wash basket through a water inlet device. Additionally, a portion of wash liquid flowing into the wash basket through the water inlet device is channeled into a wash liquid supply conduit secured to the underside of a washer lid disposed above the wash basket. The supply conduit has a drain port positioned above the funnel portion of the cover member such that wash liquid continuously drains into the receiving cup through the funnel portion during the fill cycle. The dispenser also includes an overflow means for limiting the wash liquid supplied to the receiving cup which comprises an overflow tube extending from the inner surface of the funnel portion of the cover member to the dispensing cup. In this fashion, when the wash liquid reaches the level in the receiving cup corresponding to the overflow tube, wash liquid drained into the receiving cup is channeled into the dispensing cup.

During operation, therefore, the operator pours wash additive into the funnel portion of the cover member wherein the wash additive is captured in the receiving cup. Wash liquid is then added to the receiving cup during the fill cycle as described above. Subsequent to the fill cycle, a wash cycle occurs, during which the rotational and counter-rotational action of the agitator causes the wash liquid and the wash additive disposed within the receiving cup to thoroughly mix to form a diluted wash additive. Vanes extending from the inner walls of the receiving cup are preferably provided to enhance mixing during this cycle. A high speed wash liquid extraction spin cycle, following the wash cycle, moves the diluted wash additive from the receiving cup into the dispensing cup under the influence of centrifugal force. Upon the commencement of the high speed spin cycle, the diluted wash additive drains into the wash tub from the dispensing cup.

BRIEF DESCRIPTION OF THE DRAWINGS

FIG. 8 is a frontal perspective view of an alternative embodiment of the cover member of the dispenser apparatus of the present invention.

FIG. 9 is a sectional exploded view of a second alternative embodiment of the cover member and overflow tube of the present invention.

DESCRIPTION OF PREFERRED EMBODIMENTS

Figure 1:
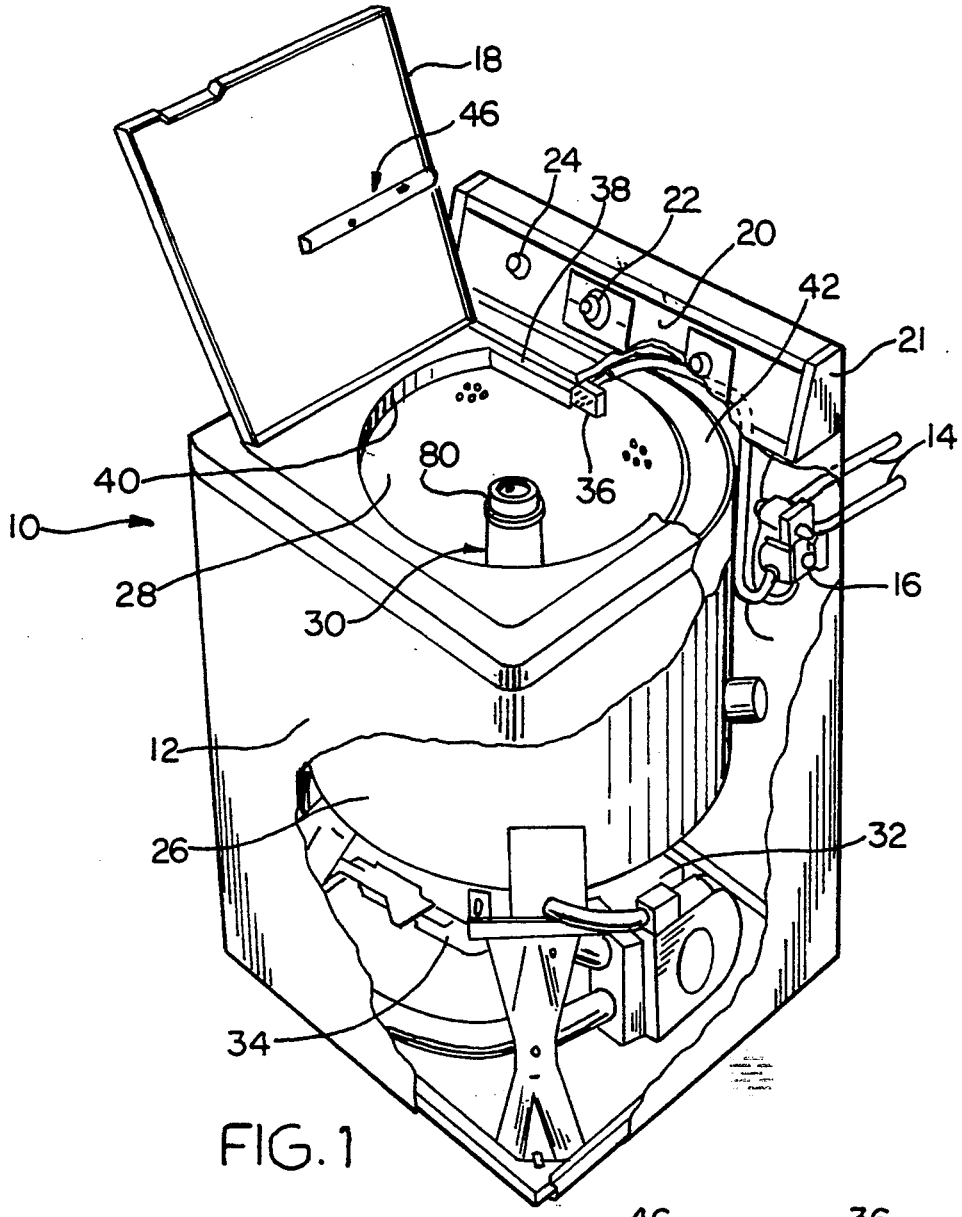
FIG. 1 is a generally frontal perspective view of an automatic washing machine of the type in which the invention may be advantageously utilized, with portions illustrated in cutaway to reveal some internal components.

Referring now in more detail to the drawings, a preferred form of the additive dispenser in accordance with the invention is intended for utilization in an automatic washer such as that shown generally in FIG. 1 and designated there by the numeral 10. As so depicted, the washer 10 is generally of a known type and includes a generally rectangular cabinet 12 for housing the operational parts of the machine, together with a hinged lid 18 through which the user may load and unload articles to be washed, as well as adding washing substances, including fabric softeners and other such additives. On the top of the cabinet 12, at the rear, is a console 21 having a control panel 20 which includes the operating controls for the washer, represented in the drawing by generic actuation knobs 22 and 24, generally of a familiar nature and including cycle and wash-type selectors, etc.

Housed within the cabinet 12 are such familiar major subassemblies or units as a wash tub 26, a basket 28 (which is usually perforate in nature), and an agitator 30. Supported at the upper portion of the agitator 30 is an additive dispenser 80. In the bottom of the cabinet are housed the drive motor 32, and some form of transmission 34, by which the agitator 30, and the basket 28, are coupled to the motor 32 for rotation. As will be understood by those skilled in the art, the tub 26, the wash basket 28, and the agitator structure 30 are concentrically mounted along a central axis, and the basket and agitator are typically mounted for separate drive motion from the motor and transmission 32, 34, so that they may be selectively rotated either oppositely or in unison to accomplish the desired wash cycle performance.

Figure 2:
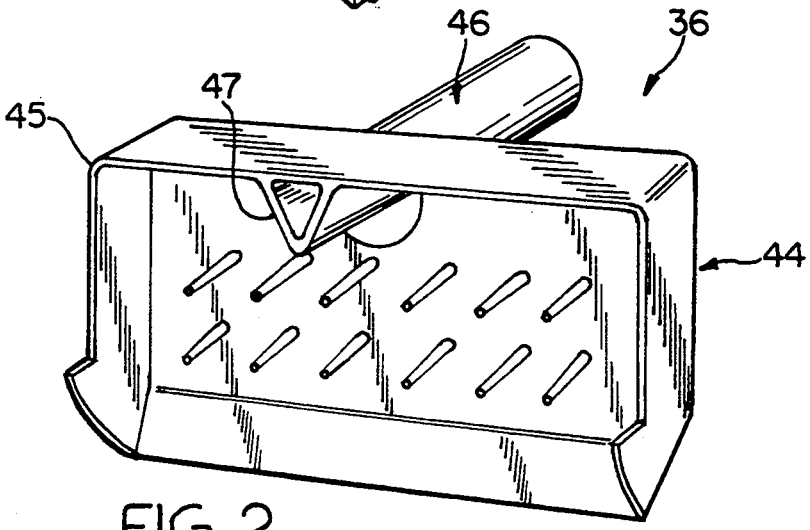
FIG. 2 is a frontal perspective view of a water inlet device of the automatic washing machine of FIG. 1, showing details thereof.

As part of the present invention, a water inlet device 36 is mounted beneath a top panel 38 forming a portion of the washer cabinet which includes an access opening 40 into the interior of the wash basket 28. A water supply 14 is interconnected with the water inlet device 36 through fill valves 16 and an inlet conduit 17. As shown in detail in FIG. 2, the inlet device 36 comprises a main body 44 having an edge portion 45. An inlet tube 46 extends from the main body 44 for interconnection with the inlet conduit 17. A v-channel 47 is disposed within the upper portion of the inlet tube 46 and extends to the edge portion 45 of the main body 44.

Figure 3:
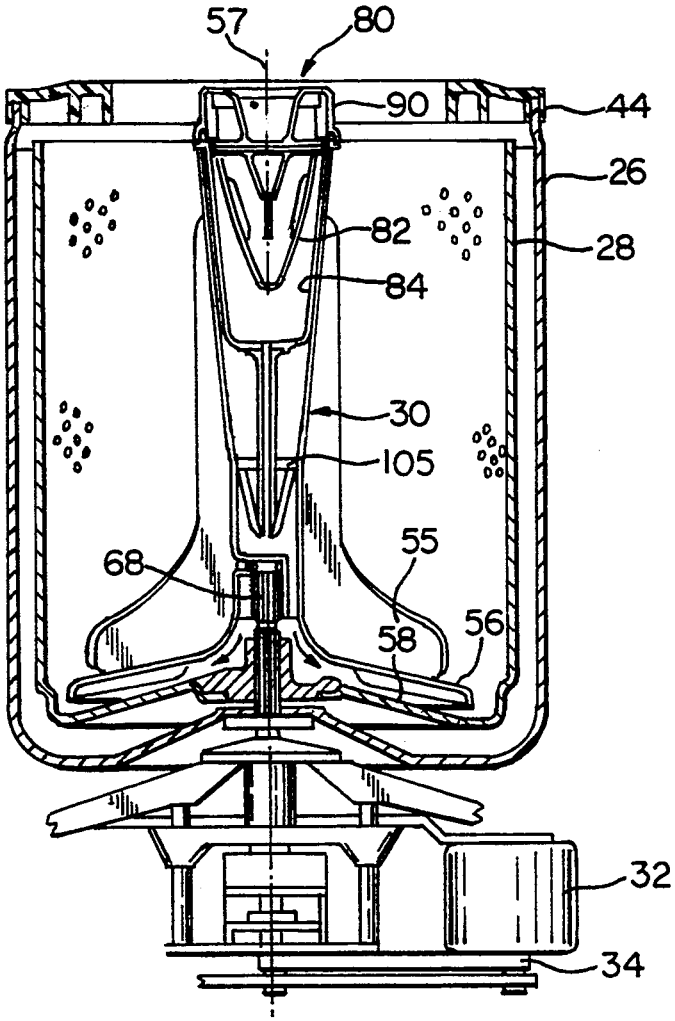
FIG. 3 is an enlarged fragmentary sectional view of a portion of the automatic washing machine shown in FIG. 1, generally showing an agitator embodying a dispenser in accordance with the present invention, together with agitator drive means.

As shown in FIG. 3, the inlet device 36 is conveniently mounted beneath the console 21 and extends over a tub ring 42 so that a portion of the inlet device is positioned above the basket. The edge portion 45 of the water inlet device 36 abuts the inner surface of an annular wall portion of the top panel 38 such that during a fill operation, wash liquid, typically water, flows through the inlet conduit 17 into the inlet tube and exits the water inlet device 36 into the wash basket 28 through the lower end of the water inlet device 36. Additionally, a portion of water flowing into the inlet tube is captured within the v-channel 47 such that water is forced through an aperture 48 in the panel 38. The v-channel is particularly effective for use in a condition of low water pressure in the water supply 14. In this condition, the v-channel 47 captures a portion of water flowing into the inlet tube 46 and ensures that some amount of water is forced through the aperture 48.

A supply conduit 49 is attached to the underside of the lid 18 for receiving water from the aperture 48 and supplying the received water to the additive dispenser 80 mounted on the agitator 30. The supply conduit 49 is oriented on the underside of the lid 18 such that a first open end 50 is disposed adjacent the aperture 48.

Water flowing through the aperture 48, therefore, must traverse a relatively small gap 51 to enter into the supply conduit 49. Upon entering the supply conduit 49, the water flows through the conduit toward a drain port 52, which is positioned directly above the additive dispenser 80 mounted on the agitator 30. In this manner, therefore, water may pass through the drain port 52 and fall into the additive dispenser 80.

The supply conduit 49 is further configured to include a plurality of overflow openings 53 such that excess water entering the supply conduit 49 may exit the supply conduit and spray onto the clothes disposed within the wash basket 28. These overflow openings 53 substantially regulate the flow of water through the drain port 52 such that a relatively constant flow of water through drain port 52 is achieved regardless of the quantity of water entering the supply conduit 49.

Figure 4:
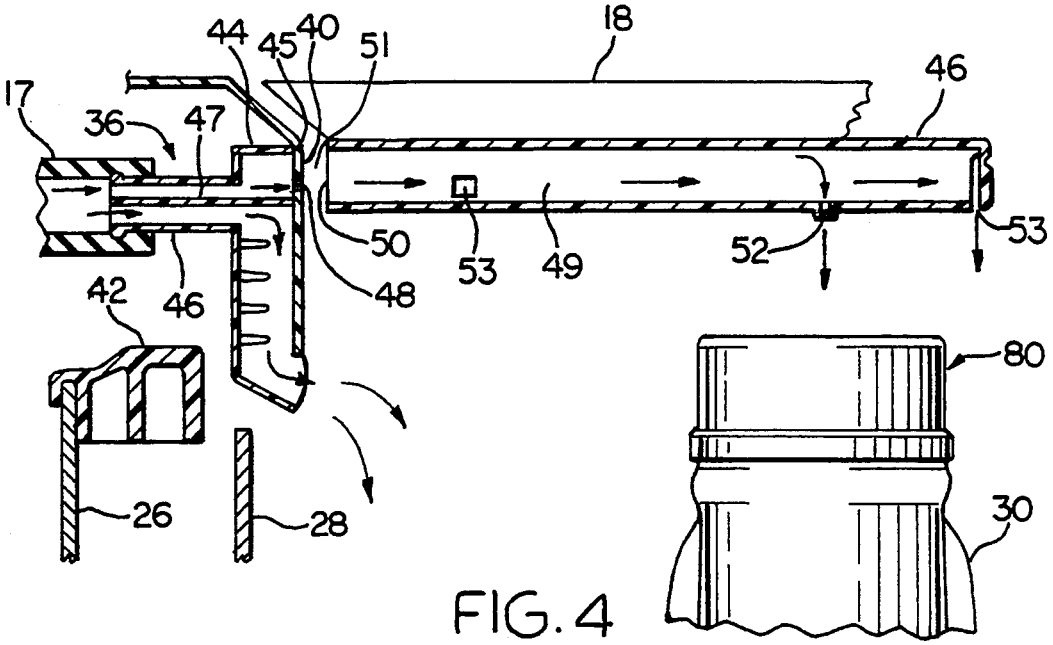
FIG. 4 is an enlarged sectional view of the lid and the water inlet device and the upper portions of the agitator, wash basket and tub taken along line 4—4 of FIG. 3.
Figure 5:
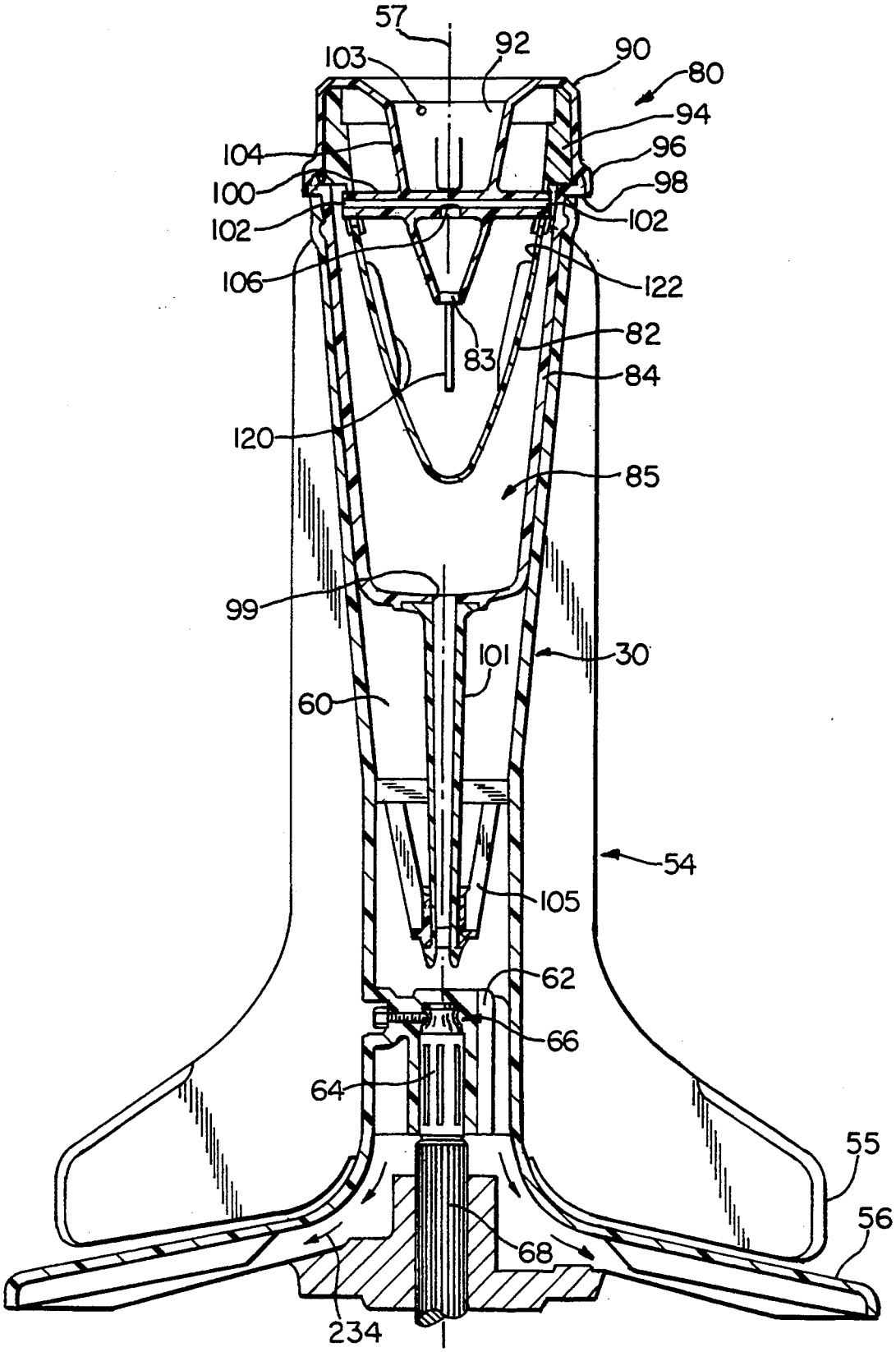
FIG. 5 is an enlarged sectional view of the agitator and dispenser shown in FIG. 2, showing details thereof.

The agitator structure 30, shown generally in FIG. 1 is illustrated in more detail in FIGS. 4 and 5. The agitation structure 30 includes a plurality of spaced, vertically-oriented vanes 54 for moving a load of clothes placed in the basket 28, so as to accomplish the desired washing action. As further shown, the vanes 54 flare outwardly at their lower extremities 55 to better accomplish this purpose, and have their lowermost edges in closely spaced relation to an angularly flared, generally annular apron or plate 56, which is concentrically disposed with respect to the remainder of the agitator structure along the rotational drive axis 57. The underside of vanes 54 is disposed directly adjacent the lower extremity 58 of the wash basket 28, sloping outwardly and downwardly toward the cylindrical sides of the latter, all in a known manner.

As further illustrated in FIGS. 4 and 5, the interior of the agitator 30 essentially defines a hollow tube 60, which contains a centrally-disposed mounting hub 62 near its lowermost extremity that has a splined interior 64 for receiving a complementary spline on the upper extremity 66 of the agitator drive shaft 68, all in generally known manner. Further, the additive dispenser 80 in accordance with the invention is, in the preferred embodiment, carried on and in the hollow uppermost extremity of the agitator 30.

Figure 6:
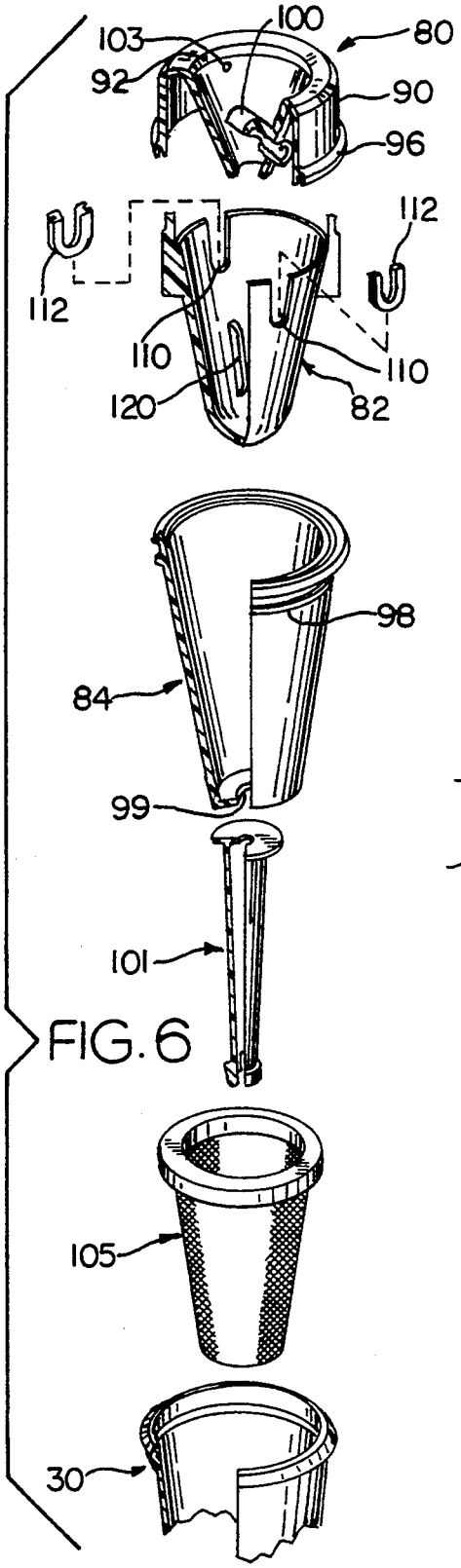
FIG. 6 is an exploded perspective view of the dispenser showing the structure thereof.

More particularly, the dispenser 80 basically comprises a pair of coaxially disposed wash additive cups 82 and 84 (FIGS. 5 and 6) which are partially telescoped with one another and within the top of the agitator tube 60, as illustrated. The lower dispensing cup 84 is nested directly within the hollow upper extremity of the agitator structure 30. The receiving cup 82 is disposed coaxially within dispensing cup 84, with the lower extremity of receiving cup 82 spaced above that of dispensing cup 84 such as to provide a dispensing compartment 85 of the dispenser apparatus.

The upper extremities of the receiving cup 82 and the dispensing cup 84 are interconnected by a toroidally shaped cover member 90 whose inner periphery defines an inlet funnel portion 92 having a restricted bottom opening 93 which extends down into the receiving cup 82. A plurality of mutually spaced, annularly-arranged inner spacers 94 is preferably disposed between the upper extremity of receiving cup 82 and the outer periphery of the cover member 90, whose lower annular extremity 96 is spin welded to the top of the dispensing cup 84. The uppermost extremity of dispensing cup 84 preferably fits snugly inside the upper extremity of the agitator tube, and is seated therein by an annular ring 98. The lowermost portion of the dispensing cup 84 has a discharge opening 99. Interconnected to the lowermost portion of the dispensing cup and aligned with the discharge opening 99 is a discharge tube 101 that supports a lint filter 103. The discharge tube 101 may be snap-fitted or spin-welded to the dispensing cup and similarly the lint filter 103 may be snap-fitted onto the lowermost extremity of the discharge tube 101.

The cover member 90 includes an overflow tube 100, intersecting the funnel portion 92 and having opposite ends 102 extending outwardly from the outer surface 104 of the funnel portion 92. The overflow tube 100 further includes an open portion 106 such that the overflow tube 100 may provide a conduit from the interior of the funnel portion 92 to the exterior of the funnel portion 92. Additionally, the cover member 90 includes a vent opening 103 disposed along the upper portion of the funnel portion 92. The vent hole 103 must be included in the cover member 90 to provide a means of relieving the air pressure that is developed in the dispenser assembly as the water in the wash basket and agitator rises when the tub 26 is filled. If vent hole 103 is not included, the air pressure in the dispenser assembly will cause the water and additive in the receiving cup 82 to be forced up and out of the funnel portion 92 of the cover member 90 before the first wash cycle begins. It is believed by the Applicants that vent hole 103 is critical to the proper operation of the present dispensing system.

The receiving cup 82 further includes a pair of slots 110 cooperating with the outwardly extending opposite ends 102 of the overflow tube 100. The slots 110 are configured to receive a pair of u-shaped grommets 112. The u-shaped grommets 112 are designed to sealingly receive the outwardly extending opposite ends 102 of the overflow tube 100 such that, when the cover member 70 and the receiving cup 92 are assembled together, the opposite ends 102 extend through the slots 110. In this fashion, therefore, the overflow tube 100 provides a conduit from the interior of the funnel portion 92 to the exterior of the receiving cup 82.

The receiving cup 82 is further configured to include a plurality of vanes 120 extending into the interior of the receiving cup 82 from an inner wall surface 122 defining a receiving zone. These vanes 120 serve to agitate the contents of the receiving cup 82 during the agitation portion of the the washer cycle and to pump out the receiving cup during the spin cycle as will be discussed in more detail below.

In general, the additive dispenser 80 in accordance herewith, operates by receiving the wash additive and water into the receiving cup 82, mixing the wash additive with the added water such that a solution of dilute wash additive is formed and subsequently dispensing the dilute wash additive solution into the wash basket under the influence of centrifugal force and gravity.

Figure 7:
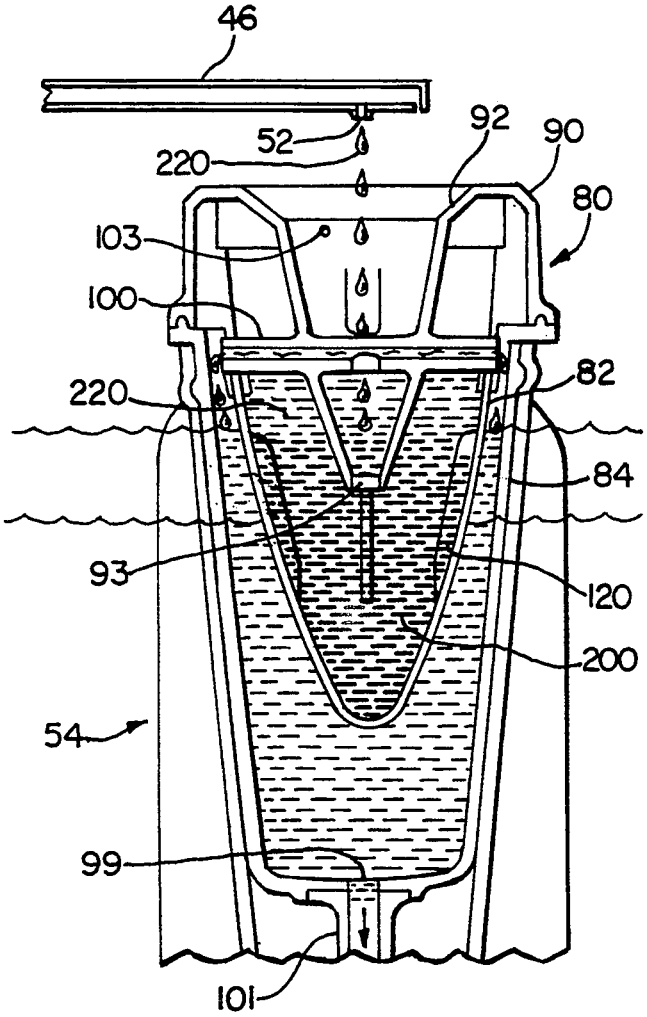
FIG. 7 is an enlarged sectional view of the dispenser apparatus and the water supply conduit, showing the dispenser during the initial fill cycle operation.

Accordingly, as shown in FIG. 7, a wash additive or fabric softener 200 is initially added by the operator to the dispenser apparatus 80 by pouring a predetermined quantity of fabric softener 200 into the funnel portion 92 of the cover member 90, wherein the wash additive 200 flows to the bottom of the receiving cup 82. Upon the initiation of the the fill cycle, the fill valves 16 are actuated and water is added to the wash basket 28 through the water inlet device 36. Simultaneously, as described above, water 220 is added to the dispenser 80 via the water supply conduit 46 and through drain port 52. The water 220 falls into the funnel portion 92 of the cover member 90 and flows into the receiving cup 82. Due to the relatively high viscosity of the wash additive 200, the water 220 may not initially mix with the wash additive 200, but instead may pool on top of the wash additive 200 as shown.

As contemplated by the present invention, the water supply conduit 49 will supply water to the dispenser apparatus continuously during the fill operation. This typically results in having an excess quantity of water supplied to the dispenser apparatus 80. Overflow means are therefore provided for channeling the excess water supplied to the funnel portion 92 to the wash basket 28. This overflow means is provided by way of the overflow tube 100 extending from the funnel portion 92 of the cover member 90.

During operation of the washer, water is added to the receiving cup 82 through the funnel portion, until the water rises in the receiving cup 82 to the level of the overflow tube 100. At this point, water added to the funnel portion 92, flows through the overflow tube 100, into the dispensing cup 84 and subsequently into the wash basket 28. Thus excess water added to the dispensing apparatus 80 is channeled out of the receiving cup with no predispensing of the wash additive. As can be understood by those of skill in the art, the water residing in the funnel portion 92 will be predominantly pure water with the restricted bottom opening 93 of the funnel portion 92 serving to prevent any substantial amount of wash additive from mixing with the water and entering the funnel portion 92. Predispensing is further prevented by the fact that, as stated above, mixing between the wash additive and the water does not typically occur readily without vigorous agitation, such that the wash additive remains in the lower-most portion of the receiving cup 82. Finally, the overflow tube 100 is positioned such that although the water level may rise in the wash basket to a point wherein the dispensing cup is partially filled with wash water, the overflow tube 100 remains above the maximum water level in the wash basket 28.

During agitation, the water and the wash additive within the receiving cup 82 mix to form a diluted wash additive solution as a result of the rotational and counter rotational action of the agitator 30 during the agitate cycle. This mixing action results, in part, from the action of the vanes 120 within the receiving cup 82, acting as agitation means and causing turbulent flow of fluid within the receiving cup 82 during agitation. The inventors have found that the use of the vanes 120 is particularly important when attempting to mix the wash additive 200 with cold water. At this temperature, the wash additive does not readily go into solution with the water without the relatively violent flow patterns created by the vanes 120.

Subsequent to the agitator cycle, the washer 10 is drained of wash liquid prior to a rinse cycle. The drain cycle typically consists of a neutral drain portion and a centrifugal extraction portion, wherein the wash basket 28 and agitator 54 are spun at a high rotational speed while wash liquid is drained from the wash tub. During this high speed spin portion of the drain cycle, the dilute wash additive solution is caused to flow, under the urgings of centrifugal force, over the edge of the receiving cup 82 into the upper portion of the dispensing cup 84. However, due to the unique configuration of the present dispenser system, wash additive solution may reside within the funnel portion 92 at the time of initiation of the high speed spin. This wash additive disposed within the funnel portion 92 may, under the influence of centrifugal force, flow upwardly out of the funnel portion 92 and spray the upper periphery of the wash basket.

This undesirable predispensing may be prevented by the use of the vanes 120 in combination with the receiving cup 82. During high speed spin, the vanes 120 act to pump wash additive upwardly and outwardly toward the upper periphery of the receiving cup. This pumping action creates a vortex effect at the bottom opening 93 of the funnel portion 92 such that fluid within the funnel portion 92 is drawn downwardly into the receiving cup 82 rather than upwardly along the inner walls of the funnel portion 92, thereby preventing the above mentioned predispensing problem.

Upon commencement of the spin activity, the dilute wash additive liquid flows, under the urgings of gravity, downwardly through the discharge opening 99 and the discharge tube 101, out the bottom of the agitator, as shown by the arrows 234. As a result of the previous mixing step, the wash additive is dilute enough to readily flow out of the dispensing cup 84 and into the wash basket 28. Without the mixing process, the inventors have found, as discussed above, that the wash additive may not flow readily out of the dispensing cup 84 and down through the agitator 30.

FIG. 8 and FIG. 9 illustrate alternative embodiments of the cover member 90 which the inventors have contemplated. In FIG. 8 the overflow tube function, as described above, may be provided by the use of two separate drain tubes 240 and 242. These drain tubes may be inserted into flange portions 244 extending from the outer surface 104 of the funnel portion 92. In FIG. 9, the cover member 90 is provided with two corresponding transverse holes 250 and 252. The overflow tube 100 is formed as a separate element for insertion into holes 250 and 252 for providing the overflow tube configuration illustrated in FIGS. 5 and 6. In this configuration, the cover member 90 may be initially configured as a toroidally shaped member without any transverse holes. The transverse holes 250 and 252 may be formed into the cover member in a secondary operation such that the overflow tube 100 may be inserted therein.

It will now be apparent that the novel dispenser system in accordance with the present invention provides a system for combining a limited amount of water with a wash additive prior to dispensing. A method and apparatus has been provided for adequately pre-mixing the water with the wash additive so as to form a diluted additive solution which will readily dispense. Furthermore, the present system provides means for rinsing the dispenser apparatus during subsequent fill cycles after the initial fill cycle.

Although the present invention has been described with reference to the disclosed embodiments, those of ordinary skill in the art will recognize that changes may be made thereto without departing from the scope and spirit of the invention as set forth in the appended claims.

We claim:

1. In an automatic washer including a tub, a basket disposed within said tub such as to rotate about a rotational axis, an agitator disposed within said basket, a motor for selectively rotating said basket and said agitator about said rotational axis and a fill valve interconnected with an external water supply for controlling a supply of washing liquid into said tub, a dispensing system comprising:

a receiving cup capable of receiving and containing a wash additive, said receiving cup being disposed on said agitator for rotation therewith, said receiving cup having an inner surface defining a receiving zone for containing said wash additive;

means for supplying wash liquid from said external source into said receiving cup;

a vane inwardly extending from said inner surface of said receiving cup into said receiving zone for enhancing mixing of said wash additive and said wash liquid disposed within said receiving cup during said agitation cycle; and means for dispensing said mixed wash additive and wash liquid from said receiving cup into said tub.

2. A dispensing system according to claim 1 further comprising:

a cover member including a funnel portion for directing said wash additive and said wash liquid into said receiving cup, said cover member being disposed on said agitator at least partially above said receiving cup; and means for channeling excess wash liquid supplied to said receiving cup directly from said funnel portion into said tub such that said wash additive is not predispensed into said tub along with said excess wash liquid.

3. A dispensing system according to claim 1 further comprising:

a cover member including a funnel portion for directing said wash additive and said wash liquid into said receiving cup, said cover member being disposed on said agitator at least partially above said receiving cup; and an overflow tube extending from the interior of said funnel portion of said cover member to the exterior of said receiving cup such that excess wash liquid supplied to said receiving cup is channeled through said overflow tube to limit the total quantity of wash liquid added to said receiving cup.

4. A dispensing system according to claim 1 wherein said automatic washer further includes a cabinet assembly surrounding said wash basket and tub, said cabinet assembly includes an openable lid interconnected with said cabinet and disposed above said wash basket, said dispensing system further comprising:

a water inlet device disposed above said wash basket, said water inlet device being fluidly interconnected with said fill valve for supplying wash liquid into said tub; and a wash fluid supply conduit interconnected with said openable lid and having an open end disposed adjacent said water inlet device for receiving a portion of said wash liquid flowing through said water inlet device, said supply conduit further having a drain port disposed above said receiving cup.

5. A dispensing system according to claim 4 wherein said wash fluid supply conduit further comprises:

an overflow opening configured such that under conditions of high wash liquid flow through said supply conduit, excess wash liquid not delivered through said drain port to said receiving cup passes through said overflow opening and sprays into said wash basket.

6. In an automatic washer including a tub, a basket disposed within said tub such as to rotate about a rotational axis, an agitator disposed within said basket, a motor for selectively rotating said basket and said agitator about said rotational axis and a fill valve interconnected with an external water supply for controlling a supply of washing liquid into said tub, a dispensing system comprising:

a receiving cup capable of receiving and containing a wash additive, said receiving cup being disposed on said agitator for rotation therewith;

a dispensing cup secured to receive said wash additive from said receiving cup, said dispensing cup being disposed at least partially below said receiving cup and disposed on said agitator for rotation therewith;

a cover member being toroidally shaped and having an inner periphery defining a funnel portion extending into said receiving cup for directing said wash additive and said wash liquid into said receiving cup, said cover member being disposed on said agitator at least partially above said receiving cup;

means for continuously supplying wash liquid from said external source into said receiving cup during operation of said fill valve;

an overflow tube extending from the interior of the funnel portion of said cover member to the exterior of said receiving cup wherein said overflow tube is positioned on said funnel portion for defining a maximum fluid level in said receiving cup such that wash liquid supplied to said receiving cup in excess of the quantity required to fill said receiving cup to said maximum fluid level is directed from said funnel directly into said dispensing cup through said overflow tube; and means for dispensing said mixed wash additive and wash liquid from said receiving cup into said tub.

7. A dispensing system according to claim 6 wherein said receiving cup has an inner surface defining a receiving zone for containing said wash additive and further comprises:

a vane inwardly extending from said inner surface into said receiving zone for enhancing mixing of said wash additive and said wash liquid disposed within said receiving cup during said agitation cycle.

8. A dispensing system according to claim 6 wherein said automatic washer further includes a cabinet assembly surrounding said wash basket and tub, said cabinet assembly having a top panel partially disposed above said tub and wash basket, said top panel including an access opening for providing access into said wash basket, said access opening comprising an annular wall portion of said top panel, an openable lid is interconnected with said cabinet and disposed above said access opening, said dispensing system further comprising:

a water inlet device disposed adjacent said annular wall portion of said top panel, said water inlet device being fluidly interconnected with said fill valve for supplying wash liquid into said tub; and a wash fluid supply conduit interconnected with said openable lid and having a open end disposed adjacent said water inlet device and further having a drain port disposed above said receiving cup; and said water inlet device having a channel for directing a portion of said wash fluid passing through said wash inlet device to said open end of said supply conduit such that wash fluid passes through said supply conduit and is supplied to said receiving cup through said drain port.

9. A dispensing system according to claim 8 wherein said wash fluid supply conduit further comprises:

an overflow opening configured such that under conditions of high wash fluid flow through said supply conduit, excess wash liquid not delivered through said drain port to said receiving cup passes through said overflow opening and sprays into said wash basket.

10. In an automatic washer including a tub, a basket disposed within said tub such as to rotate about a rotational axis, an agitator disposed within said basket, a motor for selectively rotating said basket and said agitator about said rotational axis, a dispensing system comprising:

a receiving cup interconnected with said agitator for rotation therewith, said receiving cup further having an inner surface defining a receiving zone;

a vane inwardly extending from said inner surface into said receiving zone;

a dispensing cup secured below said receiving cup, said dispensing cup further being interconnected with said agitator for rotation therewith;

a cover member including a funnel portion extending partially into said receiving cup, said cover member being disposed on said agitator at least partially above said receiving cup; and an overflow tube extending from the interior of said funnel portion of said cover member to the exterior of said receiving cup.

11. A dispensing system according to claim 10 wherein said overflow tube is an integral portion of said cover member.

12. A dispensing system according to claim 10 wherein said cover member includes a vent opening disposed along the upper portion of said funnel portion.

13. A dispensing system according to claim 10 wherein:

said dispensing cup includes a slot intersecting the upper edge of said dispensing cup and extending downwardly; and said dispensing system further comprises:

a u-shaped grommet configured to seat within said slot, said u-shaped grommet further configured to sealingly receive said overflow tube extending from said e receiving cup such that said overflow tube fluidly interconnects the interior of said funnel portion of said cover member to the exterior of said receiving cup.

14. A method of dispensing wash additive in an automatic washer, said washer including a wash basket, a tub and a dispenser mounted for selective rotation during an agitation cycle and at least one spin cycle, said method comprising the steps of:

adding said wash additive to said dispenser;

continuously supplying wash liquid to said dispenser during said wash liquid fill cycle prior to said agitation cycle;

retaining and mixing said wash additive and said wash liquid in said dispenser during agitation such that a diluted wash additive is formed; and subsequently, dispensing said diluted wash additive solution into said tub from said dispenser at the commencement of said at least one spin cycle.

15. A method of dispensing wash additive in an automatic washer according to claim 14 further comprising the step of:

draining excess wash liquid supplied to said dispenser into said wash basket, such that the amount of wash liquid combined with said wash additive is controlled to a predetermined maximum limit.

16. A method of dispensing wash additive in an automatic washer, said washer including a wash basket, a tub and a dispenser, said dispenser includes a receiving cup capable of receiving and containing a wash additive, and a dispensing cup secured to receive said wash additive from said receiving cup, both said receiving cup and said dispensing cup being disposed on said agitator for rotation therewith during an agitation cycle and at least one spin cycle, said method of dispensing wash additive comprising the steps of:

adding said wash additive to said receiving cup;

continuously supplying wash liquid to said receiving cup during said wash liquid fill cycle prior to said agitation cycle;

retaining and mixing said wash additive and said wash liquid in said receiving cup during agitation such that a diluted wash additive is formed; and transferring said diluted wash additive from said receiving cup to said dispensing cup during said at least one spin cycle; and subsequently, dispensing said diluted wash additive solution into said tub from said dispensing cup at the commencement of said at least one spin cycle.

17. A method of dispensing wash additive in an automatic washer according to claim 16 further comprising the step of:

draining excess wash liquid supplied to said receiving cup into said dispensing cup such that the amount of wash liquid combined with said wash additive is controlled to a predetermined maximum limit.

* * * * *